United States Patent [19]

Burton

[11] 4,368,750

[45] Jan. 18, 1983

[54] BALL-TYPE FEEDBACK MOTOR FOR SERVOVALVES

[75] Inventor: Robert V. Burton, Minneapolis, Minn.

[73] Assignee: Sundstrand Corporation, Rockford, Ill.

[21] Appl. No.: 901,362

[22] Filed: Apr. 28, 1978

[51] Int. Cl.[3] ..... F15B 13/043

[52] U.S. Cl. ..... 137/85; 91/433; 137/83; 137/625.63; 137/625.64

[58] Field of Search ..... 91/433; 137/83, 85, 137/625.62, 625.63, 625.64

[56] References Cited

U.S. PATENT DOCUMENTS

| | | | |
|---|---|---|---|
| 2,884,906 | 5/1959 | Atchley . | |
| 2,953,123 | 9/1960 | Reen et al. . | |
| 2,985,141 | 5/1961 | Gustafson | 91/433 |
| 2,989,987 | 6/1961 | Hayner . | |
| 2,993,477 | 7/1961 | Panissidi . | |
| 3,064,627 | 11/1962 | Blanton | 91/433 X |
| 3,095,906 | 7/1963 | Kolm . | |
| 3,101,741 | 8/1963 | Ludwig . | |
| 3,162,093 | 12/1964 | Zoller . | |
| 3,258,025 | 6/1966 | Howland | 137/625.64 X |
| 3,260,273 | 7/1966 | Hayner . | |
| 3,266,380 | 8/1966 | Eige | 137/85 X |
| 3,311,123 | 3/1967 | Tsien et al. | 137/625.64 X |
| 3,384,102 | 5/1968 | Hickox | 137/625.64 X |
| 3,424,183 | 1/1969 | Coakley | 137/625.64 X |
| 3,426,784 | 2/1969 | Vick . | |
| 3,464,318 | 9/1969 | Thayer | 137/625.62 X |
| 3,473,547 | 10/1969 | Coakley . | |
| 3,485,140 | 12/1969 | Granan et al. . | |
| 3,592,211 | 7/1971 | Spalding . | |
| 3,648,564 | 3/1972 | Burton . | |
| 3,732,887 | 5/1973 | Hayner | 137/625.62 UX |
| 3,748,454 | 7/1973 | Grier | 137/85 X |
| 3,835,888 | 9/1974 | Leutner et al. | 137/625.64 X |
| 4,291,716 | 9/1981 | Elmberg | 137/83 |

FOREIGN PATENT DOCUMENTS

| | | |
|---|---|---|
| 881055 | 11/1961 | United Kingdom . |
| 973730 | 10/1964 | United Kingdom . |
| 1206430 | 9/1970 | United Kingdom . |
| 1272859 | 5/1972 | United Kingdom . |
| 1360061 | 7/1974 | United Kingdom . |
| 1360399 | 7/1974 | United Kingdom . |

*Primary Examiner*—Gerald A. Michalsky
*Attorney, Agent, or Firm*—Ted E. Killingsworth; Michael B. McMurry; James A. Wanner

[57] ABSTRACT

A fluidic servovalve is disclosed comprising a pilot stage valve having a pilot output for supplying a control fluid dependent upon a movable element, a boost valve responsive to the control fluid for supplying an output fluid, and a fluidic mechanical feedback connected from the output of the boost valve to the pilot stage valve, the fluid mechanical feedback having a ball-type motor responsive to the output fluid acting against it for positioning the movable element.

15 Claims, 2 Drawing Figures

BALL-TYPE FEEDBACK MOTOR FOR SERVOVALVES

BACKGROUND OF THE INVENTION

This invention relates to an improvement in fluidic handling servovalves, and, more particularly, to a ball-tpye motor for providing a fluidic mechanical feedback function in the valve.

Known fluidic servovalves are comprised of three basic elements—the pilot stage, the boost valve and a feedback mechanism. The pilot stage may be an electrically operated flapper type valve having an armature around which is wound an electrical coil and which moves between magnetic pole pieces to position a flapper. The flapper then cooperates with one or more nozzles for regulating a control fluid dependent upon the position of the flapper with respect to the nozzle or nozzles. In the alternative, the pilot stage valve may be comprised of a jet pipe for issuing a jet of fluid to one or more receiving ports. The receiving ports then supply a control fluid dependent upon the position of the jet pipe with respect to the receiving ports. The position of the jet pipe may also be controlled by an electrical operator. Also, electrically driven spool-type valves or fluid amplifiers have been used in the pilot stage.

The boost valve is most often a spool valve having a plurality of lands including lands at either end of the spool. The lands at the ends of the spool define control chambers within the bore in which this spool moves. These control chambers are connected to receive the control fluid. A further land controls the amount of fluid issuing from a supply port and received by at least one output port. The position of the spool is controlled by the control fluid supplied by the pilot stage and will determine the amount of output fluid received by the output port. The fluid received by the output port is then used to position an actuator, most usually in the form of a piston.

The feedback mechanisms for providing stable and proportional operation of the servovalves have taken several forms. For example, the actuator may control a variable capacitor, inductor or resistor for providing an electrical feedback to the circuit which provides the electrical input to the pilot stage valve. A mechanical linkage may be connected between the spool of the boost valve and the flapper or jet pipe of the pilot stage valve. Pure hydraulic feedbacks from the output of the spool valve back to control chambers for the boost valve have been devised. Also, combination mechanical and fluidic feedbacks have been devised. But so far no one has devised a simple and economical motor, such as the ball-type motor of this invention, which, in response to the output fluid from the boost valve, will reposition the movable element of the pilot stage valve.

SUMMARY OF THE INVENTION

A servovalve is provided having a pilot stage for supplying a control fluid dependent upon the position of a movable element, a boost valve responsive to the pilot stage for providing an output fluid dependent upon the control fluid and a feedback ball-type motor responsive to the output fluid for repositioning the movable element. The balls used in the ball-type motor are commercially available and may be, for example, bearings which will result in an inexpensive feedback motor for repositioning the movable element in response to the output fluid supplied by the boost valve. The balls are positioned within a bore through the valve housing and may be biased against the movable element by an adjustable spring arrangement. The bore and balls do not have to be so precisely sized to provide a fluid-tight seal between the fluid chamber of the ball-type motor and the movable element. Thus, manufacture and assembly of the feedback motor is simple and cost effective.

BRIEF DESCRIPTION OF THE DRAWINGS

These and other features and advantages will become apparent from a detailed consideration of the invention when taken in conjunction with the drawings in which.

DETAILED DESCRIPTION OF THE DRAWINGS

Figure 1:
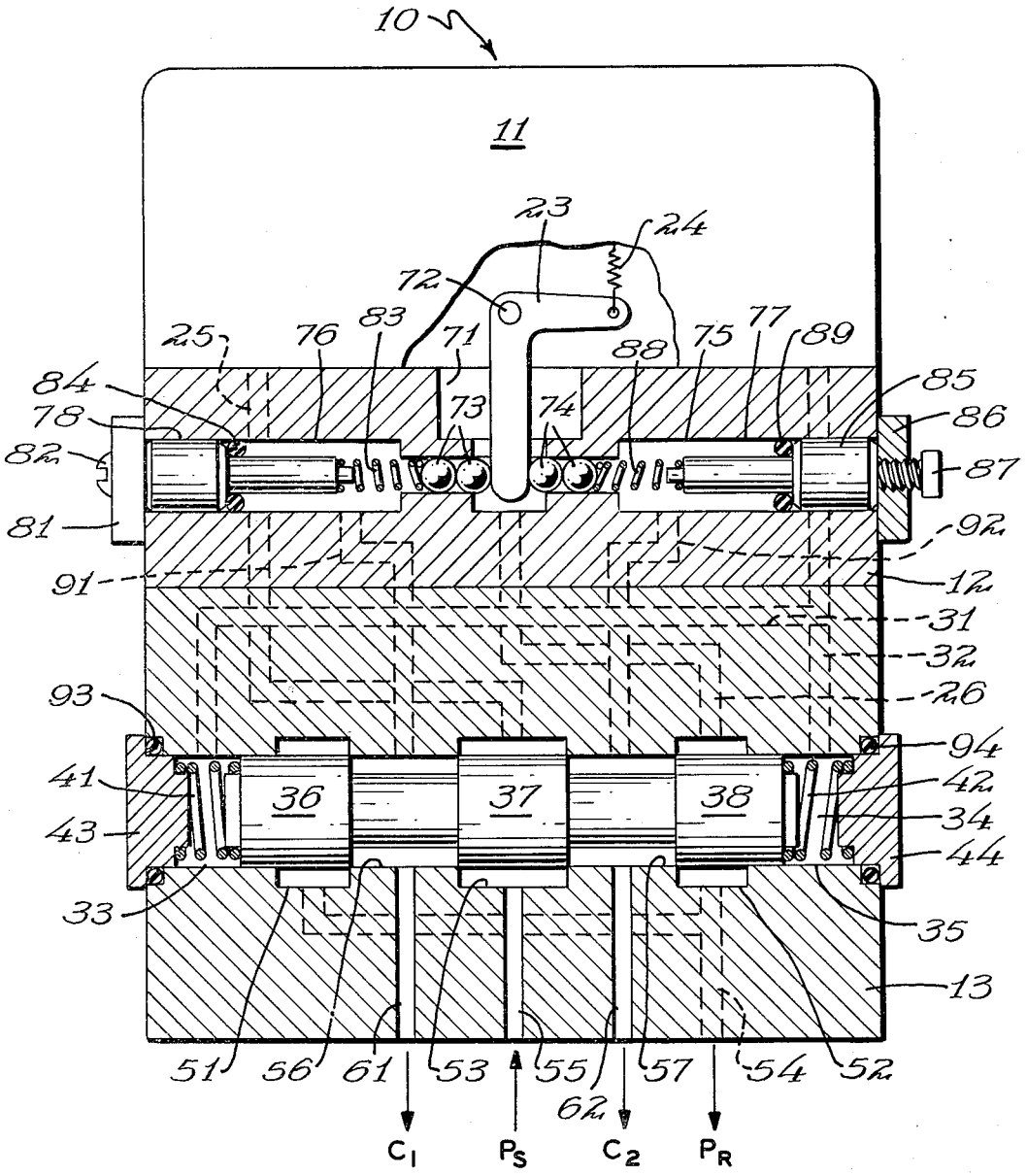
FIG. 1 is a cross-sectional view of the feedback motor and boost valve of the servovalve according to the invention; and, FIG. 2 is a schematic diagram of the servovalve according to the present invention.

As shown in the drawings, the servovalve 10 is made up of three basic parts, pilot stage 11, feedback motor 12 and boost valve 13. As shown in more detail in FIG. 2, pilot stage valve 11 may be comprised of a jet pipe 14 driven by an electrical coil 15 supplied with current from terminals 16. Coil 15 cooperates with a magnet and pole piece arrangement 17 and 18 and issues a jet of fluid to nozzles 21 and 22 for providing a control fluid to boost valve 13. Connected to the movable element in the form of jet pipe 14 is a feedback element 23 attached to jet pipe 14 by spring 24. Fluid is supplied to jet pipe 14 through supply line 25 and returned by line 26 as shown in both FIGS. 1 and 2. A more detailed description of pilot stage valve 11 can be had by referring to co-pending application Ser. No. 797,162 filed May 16, 1977.

Figure 2:
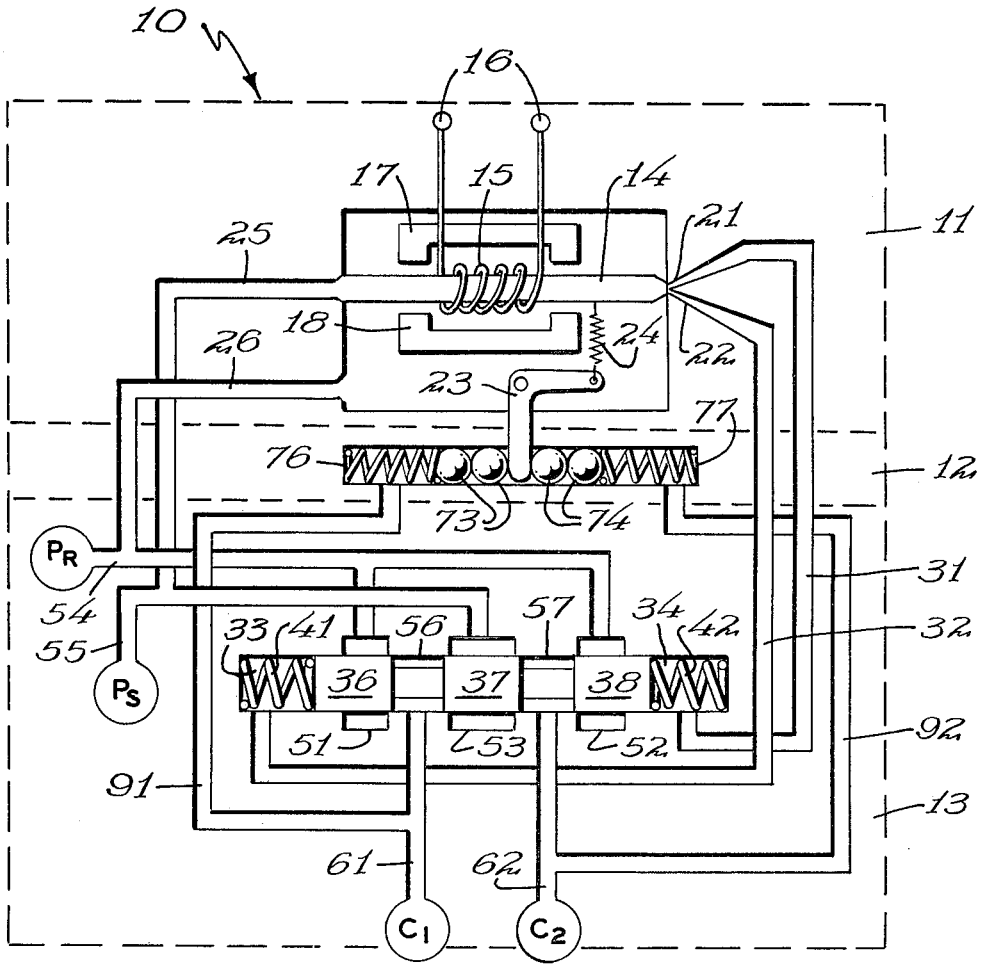

The control fluid received by ports 21 and 22 are connected to boost valve 13 by lines 31 and 32. As shown in FIG. 1, line 32 is behind line 31 through feedback motor 12. Line 31 is connected to control chamber 33 of boost valve 13 and line 32 is connected to control chamber 34.

Boost valve 13 comprises a central bore 35 within which is located a spool having lands 36, 37 and 38. The spool is centered by centering springs 41 within control chamber 33 and 42 within control chamber 34. Plug 43 biases spring 41 against land 36 and may be attached to boost valve body 13 by any suitable means such as screw-type threads and spring 42 is biased against land 38 by plug 44 which again may be attached to valve body 13 by any suitable means. Return chambers 51 and 52 and supply chamber 53 are provided having larger diameters than bore 35, return chambers 51 and 52 connected to a pressure return port 54 and supply chamber 53 connected to a supply port 55. Between lands 36 and 37 in bore 35 is defined output chamber 56 and between lands 37 and 38 is defined an output chamber 57. Output chamber 56 supplies an output fluid to output port 61 and output chamber 57 supplies an output fluid to output port 62. As the spool is moved one way or the other from its center position, one of the output ports 61 and 62 is connected to supply port 55 and the other is connected to return port 54. O-rings 93 and 94 are provided for sealing in the fluid within control chambers 33 and 34 of boost valve 13.

Feedback motor 12 has a narrow slot 71 as shown into which the pilot valve feedback element 23 extends.

Element 23 is L-shaped and rotates about pivot 72 at the junction of its two legs. Feedback arm 23 is moved by balls 73 on one side and 74 on the other acting on one leg of element 23 and located within a reduced diameter portion of bore 75. Located at either end of bore 75 are control chambers 76 and 77 having a diameter greater than the reduced diameter portion within which balls 73 and 74 are located. Within control chamber 76 is a plug 78 held in by plate 81 attached to the body of feedback motor 12 by a suitable means such as screw 82. Plug 78 operates against spring 83 for providing a centering bias to balls 73. An O-ring 84 is provided to seal in the fluid within control chamber 76.

Within chamber 77 is a plug 85 held within chamber 77 by plate 86 fastened to the body of feedback motor 12 by any suitable means. Through plate 86 is a biasing screw 87 for adjusting the force on centering spring 88 biasing balls 74 against feedback element 23. A suitable O-ring 89 may be provided for sealing in the fluid within chamber 77.

Control chamber 76 is connected to output chamber 56 of boost valve 13 by line 91 and output chamber 57 of the boost valve is connected to control chamber 77 by line 92.

IN OPERATION

When jet pipe 14 is in its center position, ports 21 and 22 receive equal pressures from the jet stream supplied by jet pipe 14 such that the pressures within control chambers 33 and 34 are equal and the spool of boost valve 13 is centered. If an appropriate input signal is supplied to terminals 16 connected to coil 15 such that jet pipe 14 is moved to increase the pressure within port 21 and to decrease the pressure within port 22, the pressure within control chamber 34 increases and the pressure within control chamber 33 decreases driving the spool to the left. Land 36 opens return chamber 51 to output chamber 56 such that fluid flows up through port 61 into output chamber 56, through return chamber 51 and return line 54 to the pressure return. At the same time, land 37 opens supply chamber 53 to output chamber 57 to allow fluid to flow from supply port 55 through supply chamber 53, output chamber 57 and then through outlet port 62. This operation results in a decrease in pressure in output chamber 56 and an increase in pressure in output chamber 57.

Since output chamber 56 is connected to control chamber 76 of feedback motor 12 by line 91, there will be a concomitant decrease in pressure within control chamber 76. At the same time, since control chamber 77 is connected to output chamber 57, there will be a comcomitant increase in pressure in control chamber 77. The pressure differential across balls 73 and 74 will move them to the left rotating feedback element 23 in a clockwise direction repositioning jet pipe 14 in a direction to equalize the pressure within ports 21 and 22 which will tend to return the spool of boost valve 13 to its center position.

On the other hand, if the electrical signal applied to terminals 16 and coil 15 positioned jet pipe 14 to increase pressure within port 22 and decrease the pressure within port 21, the pressure within control chamber 33 of boost valve 13 will increase and the pressure within chamber 34 will decrease. The spool of boost valve 13 will, therefore, move to the right connecting output port 62 to return port 54 for decreasing the pressure within chamber 57 and connecting output port 61 to supply port 55 for increasing the pressure within chamber 56. This operation results in an increased pressure within control chamber 76 and a decreased pressure within control chamber 77 of feedback motor 12 driving the balls 73 and 74 to the right allowing counterclockwise rotation of feedback element 73 returning jet pipe 14 to its center position tending to reestablish the equalization of pressures within ports 21 and 22 and tending to recenter the spool of boost valve 13 for maintaining the pressure differential between output lines 61 and 62.

Balls 73 and 74 do not have to provide a fluid-tight seal within the reduced diameter portion of bore 75 but need only be tight enough to maintain the pressure differential between the fluid within control chambers 76 and 77 and the slot 71. Any fluid which leaks from these chambers around balls 73 and 74 into chamber 71 is connected to return port 54 by way of return line 26. Chamber 71 also provides a return for the fluid issuing from jet pipe 14 within pilot stage valve 11. Since balls 73 and 74 do not have to provide a fluid-tight seal within the reduced diameter portion of bore 75, balls 73 and 74 do not have to be precision bearings but may be acquired from available commercial supplies and the reduced diameter portion of bore 75 does not have to be precision machined. Thus, the feedback motor 12 may be economically manufactured and assembled.

The embodiments of the invention in which an exclusive property or right is claimed are defined as follows:

1. A fluidic servovalve comprising:

pilot stage valve means having a movable element comprised of a jet pipe connected to a source of supply pressure for issuing a jet of fluid and further having a first output arranged for receiving a portion of said jet of fluid and for supplying a control fluid dependent upon the position of said jet pipe with respect to said first output;

boost valve means connected to said first output, said boost valve means having a second output for supplying an output fluid dependent upon said control fluid; and, feedback ball-type motor means connected between said second output and said movable element, said feedback ball-type motor means having balls responsive to said output fluid and acting against said movable element for repositioning ssid movable element in response to said output fluid.

2. The servovalve of claim 1 wherein said first output comprises first and second ports for receiving a differential fluid pressure from said jet pipe dependent upon the position of said jet pipe with respect to said first and second ports.

3. The servovalve of claim 2 wherein said *movable element* further comprises electrical input means for positioning said jet pipe with respect to said first and second ports in response to an electrical input signal.

4. The servovalve of claim 3 wherein said boost valve means is connected to said first and second ports.

5. The servovalve of claim 4 wherein said boost valve means comprises a bore and a spool located within said bore, said spool having first and second lands and a middle land between said first and second lands, said first and second lands defining first and second control chambers, said first control chamber connected to said first port and said second control chamber connected to said second port.

6. The servovalve of claim 5 wherein said second output comprises a first output chamber defined by said first and middle lands within said bore and a second output chamber defined by said second and middle lands within said bore, said first and second output chambers connected to said feedback ball-type motor means for supplying said output fluid to said feedback ball-type motor means for repositioning said movable element.

7. The servovalve of claim 6 wherein said bore of said boost valve means further comprises first and second enlarged diameter portions cooperating with said corresponding first and second lands and a middle enlarged portion cooperating with said middle land, said first and second enlarged portions connected to a return line and said middle enlarged portion connected to a supply line.

8. The servovalve of claim 7 wherein said feedback ball-type motor means comprises a bore within which said balls are located acting in response to said output fluid and against said movable element.

9. The servovalve of claim 8 wherein said balls are positioned on either side of said movable element within said bore of said feedback ball-type motor means and said feedback ball-type motor means further comprises first and second control chambers each of which is defined by respective enlarged portion of said bore of said feedback ball-type motor means on a respective side of said balls.

10. The servovalve of claim 9 wherein said first control chamber of said feedback ball-type motor means is connected to said first output chamber of said boost valve means and said second control chamber of said feedback ball-type motor means is connected to said second output chamber of boost valve means.

11. A fluidic servovalve comprising:

pilot stage valve means having a movable element and a first output, said first output supplying a control fluid dependent upon said movable element;

boost valve means having a bore and a spool located within said bore, said spool having first and second lands and a middle land between said first and second lands, sad first and second lands defining first and second control chambers connected to said first output, a first output chamber defined by said first and middle lands within said bore, and a second output chamber defined by said second and middle lands within said bore; and, feedback ball-type motor means connected to said first and second output chambers of said boost valve means, said feedback ball-type motor means having balls responsive to said output fluid from said boost valve means and acting against said movable element for repositioning said movable element in response to said output fluid.

12. The servovalve of claim 11 wherein said bore of said boost valve means further comprises first and second enlarged diameter portions cooperating with said corresponding first and second lands and a middle enlarged portion cooperating with said middle land, said first and second enlarged portions connected to a return line and said middle enlarged portion connected to a supply line.

13. The servovalve of claim 12 wherein said feedback ball-type motor means comprises a bore within which said balls are located acting in response to said output fluid and against said movable element.

14. The servovalve of claim 13 wherein said balls are positioned on either side of said movable element within said bore of said feedback ball-type motor means and said feedback ball-type motor means further comprises first and second control chambers each of which is defined by a respective enlarged portion of said bore of said feedback ball-type motor means on a respective side of said balls.

15. The servovalve of claim 14 wherein said first control chamber of said feedback ball-type motor means is connected to said first output chamber of said boost valve means and said second control chamber of said feedback ball-type motor means is connected to said second output chamber of boost valve means.

* * * * *